US009140484B2

(12) United States Patent
Veltrop

(10) Patent No.: US 9,140,484 B2
(45) Date of Patent: Sep. 22, 2015

(54) REFRIGERATED POINT-OF-USE HOLDING CABINET USING CHILLED LIQUID

(71) Applicant: Prince Castle, LLC., Carol Stream, IL (US)

(72) Inventor: Loren Veltrop, Chicago, IL (US)

(73) Assignee: PRINCE CASTLE LLC, Carol Stream, IL (US)

( * ) Notice: Subject to any disclaimer, the term of this patent is extended or adjusted under 35 U.S.C. 154(b) by 0 days.

(21) Appl. No.: 14/189,269

(22) Filed: Feb. 25, 2014

(65) Prior Publication Data

US 2014/0165644 A1 Jun. 19, 2014

Related U.S. Application Data

(62) Division of application No. 13/567,821, filed on Aug. 6, 2012, now Pat. No. 8,667,807, and a division of application No. 12/782,843, filed on May 19, 2010, now Pat. No. 8,607,587.

(51) Int. Cl.

| | |
|---|---|
| ***F25D 23/00*** | (2006.01) |
| ***F25D 25/02*** | (2006.01) |
| ***A47F 3/06*** | (2006.01) |
| ***F25B 21/02*** | (2006.01) |
| ***F25D 19/00*** | (2006.01) |

(52) U.S. Cl.

CPC ..... *F25D 25/028* (2013.01); *A47F 3/06* (2013.01); *F25B 21/02* (2013.01); *F25D 19/006* (2013.01); *F25D 23/003* (2013.01)

(58) Field of Classification Search

USPC ..... 62/252, 253, 382, 431, 441, 443, 447

See application file for complete search history.

(56) References Cited

U.S. PATENT DOCUMENTS

| | | | |
|---|---|---|---|
| 3,696,720 | A | 10/1972 | Vinson |
| 3,950,632 | A | 4/1976 | Rivelli |
| 3,979,056 | A | 9/1976 | Barnes |
| 4,036,995 | A | 7/1977 | Koether et al. |
| 4,077,690 | A | 3/1978 | Koether |

(Continued)

FOREIGN PATENT DOCUMENTS

| | | |
|---|---|---|
| JP | 8000414 | 1/1996 |
| JP | 10079088 | 3/1998 |

(Continued)

OTHER PUBLICATIONS

Final Office Action, U.S. Appl. No. 13/567,821, dated Jun. 6, 2013.

(Continued)

*Primary Examiner* — Daniel Rohrhoff

(74) *Attorney, Agent, or Firm* — Marshall, Gerstein & Borun LLP

(57) ABSTRACT

A refrigerated point-of-use food holding cabinet keeps food products cold in compartments having cross sections that are substantially U-shaped. Food products are kept refrigerated using heat-absorbing, heat-exchangers thermally coupled to the U-shaped compartment. Refrigeration is provided by a chilled, re-circulating liquid that does not change phase as it circulates but which is chilled by another refrigeration system, such as a conventional refrigeration system. An optional cover helps prevent food flavor transfers between compartments. Semiconductor temperature sensors and a computer effectuate temperature control.

17 Claims, 15 Drawing Sheets

(56) References Cited

U.S. PATENT DOCUMENTS

| | | | | |
|---|---|---|---|---|
| 4,278,872 | A | 7/1981 | Koether et al. | |
| 4,306,616 | A | 12/1981 | Woods, Jr. et al. | |
| 4,388,689 | A | 6/1983 | Hayman et al. | |
| 4,530,067 | A | 7/1985 | Dorr | |
| 4,569,421 | A | 2/1986 | Sandstedt | |
| 4,610,238 | A | 9/1986 | Veth | |
| 4,644,931 | A | 2/1987 | Veth | |
| 4,688,475 | A | 8/1987 | Witt et al. | |
| 4,740,888 | A | 4/1988 | Ceste, Sr. et al. | |
| 4,742,455 | A | 5/1988 | Schreyer | |
| 4,782,445 | A | 11/1988 | Pasquini | |
| 4,812,625 | A | 3/1989 | Ceste, Sr. | |
| 4,812,963 | A | 3/1989 | Albrecht et al. | |
| 4,864,498 | A | 9/1989 | Pasquini et al. | |
| 4,911,068 | A | 3/1990 | Koether et al. | |
| 4,922,435 | A | 5/1990 | Cahlander et al. | |
| 5,003,472 | A | 3/1991 | Perrill et al. | |
| 5,069,273 | A | 12/1991 | O'Hearne | |
| 5,093,556 | A | 3/1992 | Oelfke | |
| 5,128,862 | A | 7/1992 | Mueller | |
| 5,132,914 | A | 7/1992 | Cahlander et al. | |
| 5,172,328 | A | 12/1992 | Cahlander et al. | |
| 5,188,020 | A | 2/1993 | Buchnag | |
| 5,216,918 | A | 6/1993 | Landis et al. | |
| 5,218,527 | A | 6/1993 | Ishikawa et al. | |
| 5,247,807 | A | 9/1993 | Jarman et al. | |
| 5,253,564 | A | 10/1993 | Rosenbrock et al. | |
| 5,357,426 | A | 10/1994 | Morita et al. | |
| D364,530 | S | 11/1995 | Robards, Jr. et al. | |
| 5,485,780 | A | 1/1996 | Koether et al. | |
| 5,504,589 | A | 4/1996 | Montague et al. | |
| 5,510,979 | A | 4/1996 | Moderi et al. | |
| 5,539,671 | A | 7/1996 | Albrecht et al. | |
| 5,553,312 | A | 9/1996 | Gattey et al. | |
| 5,579,952 | A | 12/1996 | Fiedler et al. | |
| 5,590,586 | A | 1/1997 | Ulfig et al. | |
| 5,594,222 | A | 1/1997 | Caldwell | |
| 5,616,269 | A | 4/1997 | Fowler et al. | |
| 5,653,906 | A | 8/1997 | Fowler et al. | |
| 5,724,886 | A | 3/1998 | Ewald et al. | |
| 5,772,072 | A | 6/1998 | Prescott et al. | |
| 5,812,393 | A | 9/1998 | Drucker | |
| 5,900,173 | A | 5/1999 | Robards, Jr. | |
| 5,921,096 | A * | 7/1999 | Warren | 62/185 |
| 5,931,083 | A | 8/1999 | Stanger et al. | |
| 5,939,974 | A | 8/1999 | Heagle et al. | |
| 5,947,012 | A | 9/1999 | Ewald et al. | |
| 6,000,622 | A | 12/1999 | Tonner et al. | |
| 6,006,996 | A | 12/1999 | Bhatnagar | |
| 6,011,243 | A | 1/2000 | Arnold et al. | |
| 6,026,372 | A | 2/2000 | Savage | |
| 6,031,208 | A | 2/2000 | Witt et al. | |
| 6,052,667 | A | 4/2000 | Walker et al. | |
| D427,008 | S | 6/2000 | Wasner | |
| D427,479 | S | 7/2000 | Wasner | |
| 6,088,681 | A | 7/2000 | Coleman et al. | |
| 6,114,659 | A | 9/2000 | Finck et al. | |
| 6,116,154 | A | 9/2000 | Vaseloff | |
| 6,119,587 | A | 9/2000 | Ewald et al. | |
| 6,153,244 | A | 11/2000 | Stanger et al. | |
| 6,158,885 | A | 12/2000 | Landis | |
| 6,175,099 | B1 * | 1/2001 | Shei et al. | 219/399 |
| 6,200,944 | B1 | 3/2001 | Dovey et al. | |
| 6,209,447 | B1 | 4/2001 | Ewald et al. | |
| 6,257,010 | B1 | 7/2001 | Shei et al. | |
| 6,261,621 | B1 | 7/2001 | Stanger et al. | |
| 6,262,394 | B1 | 7/2001 | Shei et al. | |
| 6,412,403 | B1 | 7/2002 | Veltrop | |
| 6,434,961 | B2 | 8/2002 | Richmond et al. | |
| 6,541,739 | B2 | 4/2003 | Shei et al. | |
| 6,637,322 | B2 | 10/2003 | Veltrop | |
| 6,658,994 | B1 | 12/2003 | McMillan | |
| 6,825,447 | B2 | 11/2004 | Kim et al. | |
| 6,834,276 | B1 | 12/2004 | Jensen et al. | |
| 6,878,391 | B2 | 4/2005 | Veltrop | |
| 6,884,451 | B2 | 4/2005 | Veltrop | |
| 7,028,498 | B2 | 4/2006 | Monroe et al. | |
| 7,105,779 | B2 | 9/2006 | Shei | |
| 7,132,926 | B2 | 11/2006 | Vaseloff et al. | |
| 7,227,102 | B2 | 6/2007 | Shei | |
| 7,235,762 | B2 | 6/2007 | Gagas et al. | |
| 7,238,654 | B2 | 7/2007 | Hodge et al. | |
| 7,258,064 | B2 | 8/2007 | Vaseloff et al. | |
| 7,279,659 | B2 | 10/2007 | Gagas et al. | |
| RE40,151 | E | 3/2008 | Shei et al. | |
| RE40,290 | E | 5/2008 | Shei et al. | |
| 7,376,485 | B2 | 5/2008 | Salerno | |
| D570,715 | S | 6/2008 | Di Federico | |
| 7,381,927 | B1 | 6/2008 | Agnello | |
| 7,446,282 | B2 * | 11/2008 | Shei et al. | 219/391 |
| 7,628,107 | B2 | 12/2009 | Vaseloff et al. | |
| 8,247,745 | B2 * | 8/2012 | Chung et al. | 219/494 |
| 8,607,587 | B2 | 12/2013 | Veltrop | |
| 8,667,807 | B2 | 3/2014 | Veltrop | |
| 2004/0000162 | A1 | 1/2004 | Song | |
| 2005/0236947 | A1 | 10/2005 | LeClear et al. | |
| 2006/0150662 | A1 | 7/2006 | Lee et al. | |
| 2007/0017245 | A1 * | 1/2007 | Song et al. | 62/443 |
| 2007/0144202 | A1 | 6/2007 | Theodos et al. | |
| 2007/0251397 | A1 | 11/2007 | Dorsten et al. | |
| 2008/0213449 | A1 | 9/2008 | Wisner et al. | |
| 2009/0045185 | A1 | 2/2009 | Schroeder et al. | |
| 2009/0309027 | A1 | 12/2009 | Von Striver | |
| 2010/0205992 | A1 | 8/2010 | Morris | |

FOREIGN PATENT DOCUMENTS

| | | |
|---|---|---|
| JP | 11342061 | 12/1999 |
| WO | WO-01/31533 A1 | 5/2001 |
| WO | WO-2005/034633 A1 | 4/2005 |

OTHER PUBLICATIONS

Final Office Action, U.S. Appl. No. 12/782,843, dated Dec. 31, 2012.
Frymaster HCP Installation and Operation Manual, Dec. 2006, pp. 1-1 to 10-14, title page and table of contents; publisher, Endosi, Frymaster LLC, Shreveport, LA.
Non-Final Office Action, U.S. Appl. No. 12/782,843, dated Aug. 21, 2012.
Non-Final Office Action, U.S. Appl. No. 12/782,843, dated Jun. 19, 2013.
Non-Final Office Action, U.S. Appl. No. 13/567,821, dated Feb. 8, 2013.
Prince Castle LLC, Holding Bins (www.princecastle.com).
Prince Castle LLC, Holding Panels (www.princecastle.com).
Thermodyne Food Products, Inc., Counter Top Holding Oven Model 300 NDNL specification.

* cited by examiner

REFRIGERATED POINT-OF-USE HOLDING CABINET USING CHILLED LIQUID

RELATED APPLICATIONS

This application is a divisional of U.S. application Ser. No. 13/567,821 filed Aug. 6, 2012, which was a divisional of U.S. application Ser. No. 12/782,843, filed May 19, 2010, and which issued Dec. 17, 2013, as U.S. Pat. No. 8,607,587.

BACKGROUND

Many restaurants' success depends on how quickly customers can be served with food items that a customer orders and on the quality of the food when it is served. If the rate at which a restaurant prepares food products equals the rate at which those same food products are ordered and sold, a restaurant can theoretically have freshly-prepared foods ready to serve for customers as they arrive. Since it is not always possible to match food production with customer ordering rates, and since certain fast food restaurant customers expect to receive their ordered food items quickly, many fast food restaurants prepare various food items and keep them ready for sale until a customer arrives and purchases a pre-cooked food item.

Holding ovens to keep food warm are well known. Many such ovens allow a cooked food item to be put into the oven from one side of the oven and taken from the oven on the opposite side whereby food preparers add food to the oven and food servers take food from the oven.

While food holding ovens are well known and enable a restaurant service provider to keep food warm until served, a refrigerated food holding cabinet that provides the same or nearly the same functionality might enable a restaurant to keep foods like salads, cold until they are ready for consumption. Unlike a conventional refrigerator, which has a door that opens and closes, and which is awkward to use in many restaurants, a refrigerated, point-of-use holding cabinet would therefore be an improvement over the prior art.

DETAILED DESCRIPTION

Figure 1:
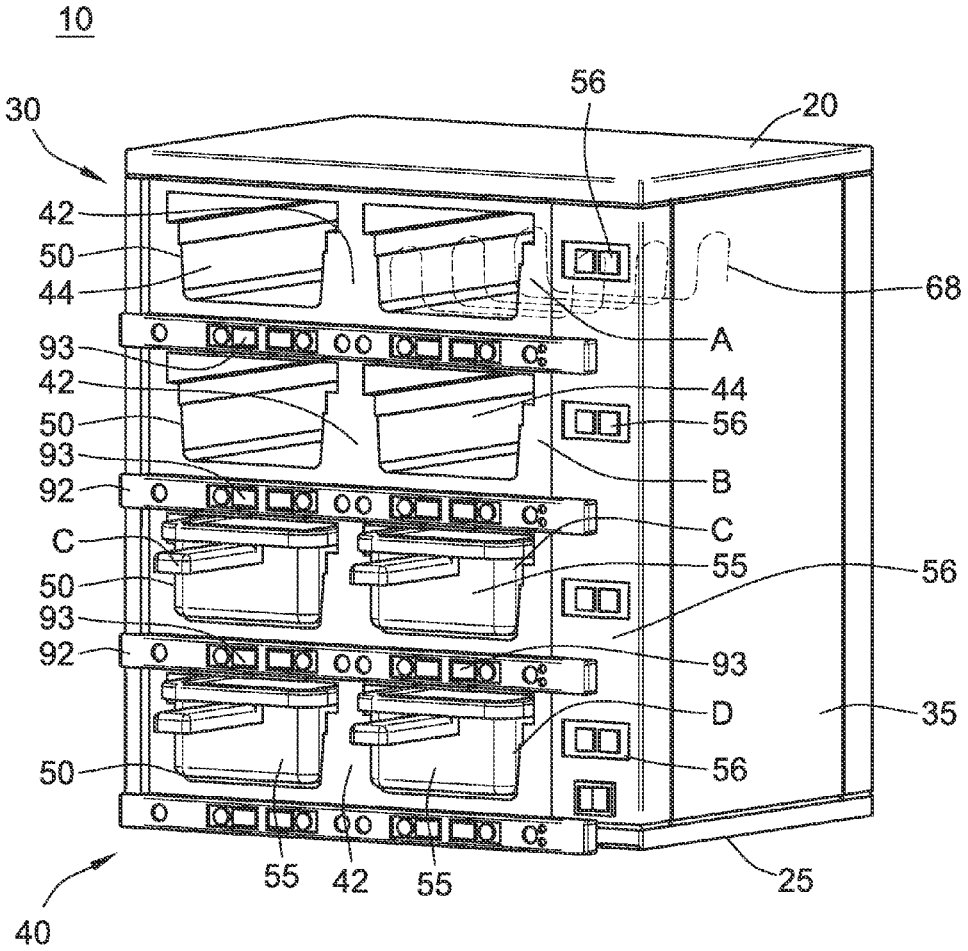
FIG. 1 is a perspective view of a refrigerated point-of-use food holding cabinet.

FIG. 1 is a perspective view of a refrigerated point-of-use food holding cabinet 10. The cabinet 10 is comprised of a top panel 20, a bottom panel 25, left-side panel 30, right side panel 35, a front side 40 and a rear side 45, which is not visible in FIG. 1. The panels 20, 25, 30 and 35 are preferably insulated to reduce heat transfer between the interior of the cabinet 10 and air surrounding the cabinet 10.

The cabinet in the figure is sized, shaped and arranged to have four vertical levels or tiers denominated by the letters, A, B, C and D. The tiers A-D are considered herein to be "stacked" on top of each other with the "A" tier being the top or upper-most tier. The "B" tier is below the "A" tier but above the "C" tier. The "D" tier is the bottom or lowest tier in the cabinet 10.

Figure 2A:
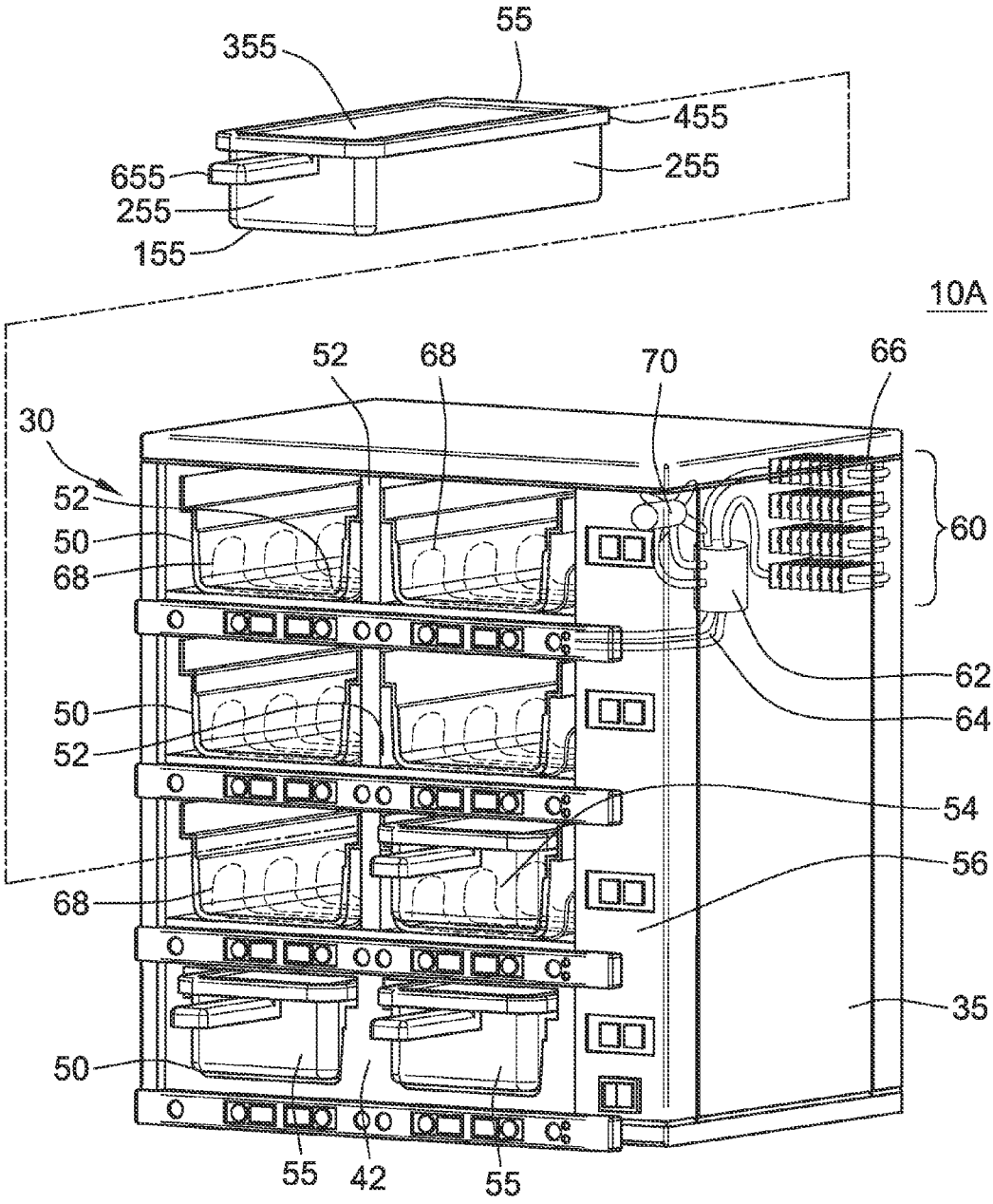
FIG. 2A is a perspective view of a first embodiment of a refrigerated point-of-use holding cabinet.
Figure 2B:
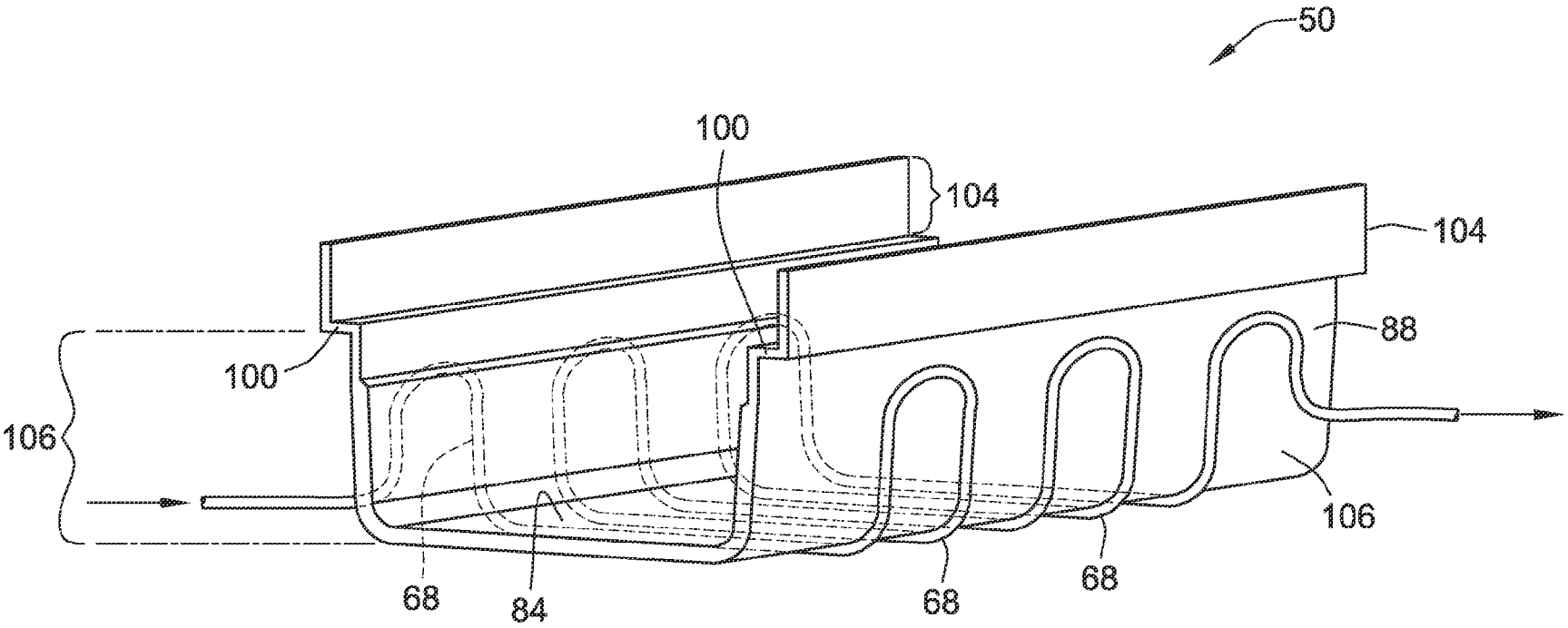
FIG. 2B is a perspective view of one tray-receiving member used in the cabinet shown in FIG. 2A.
Figure 2C:
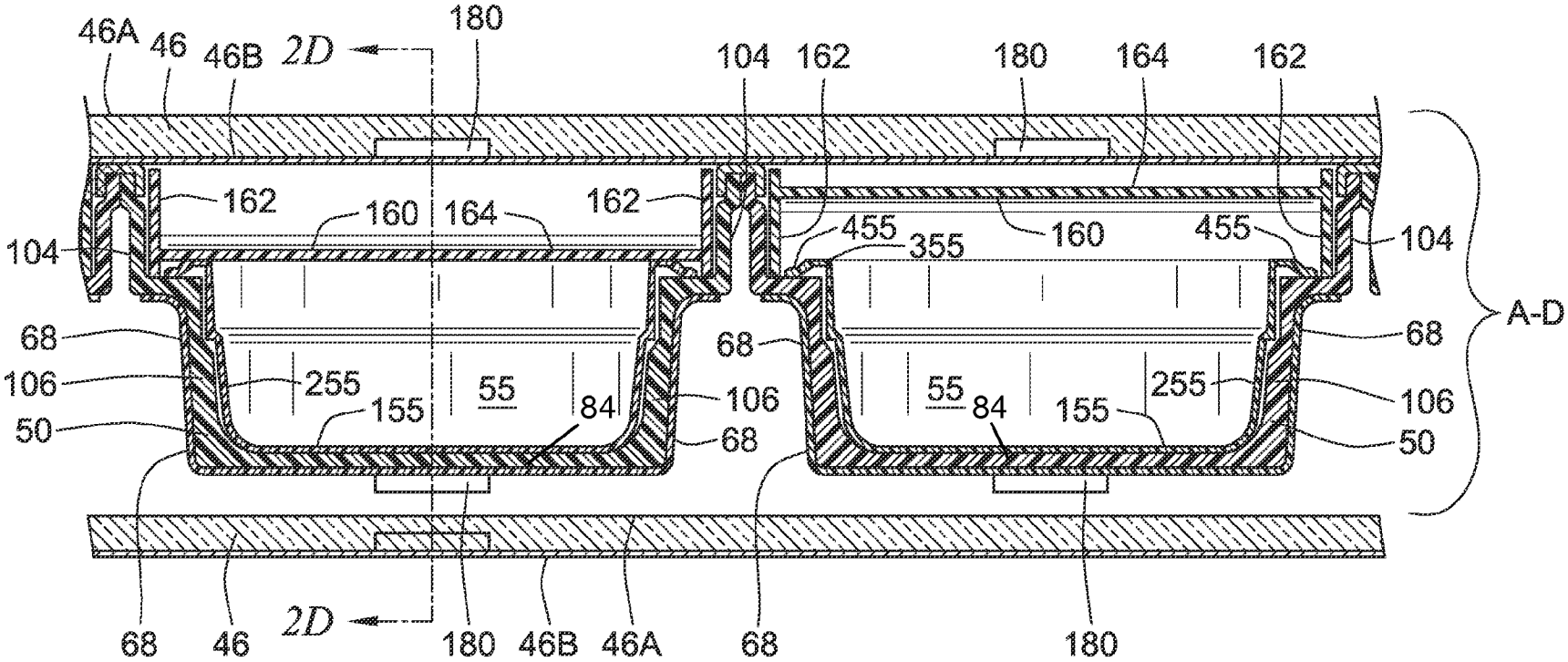
FIG. 2C is a cross-sectional view of one tier of the cabinet shown in FIG. 2A.
Figure 2D:
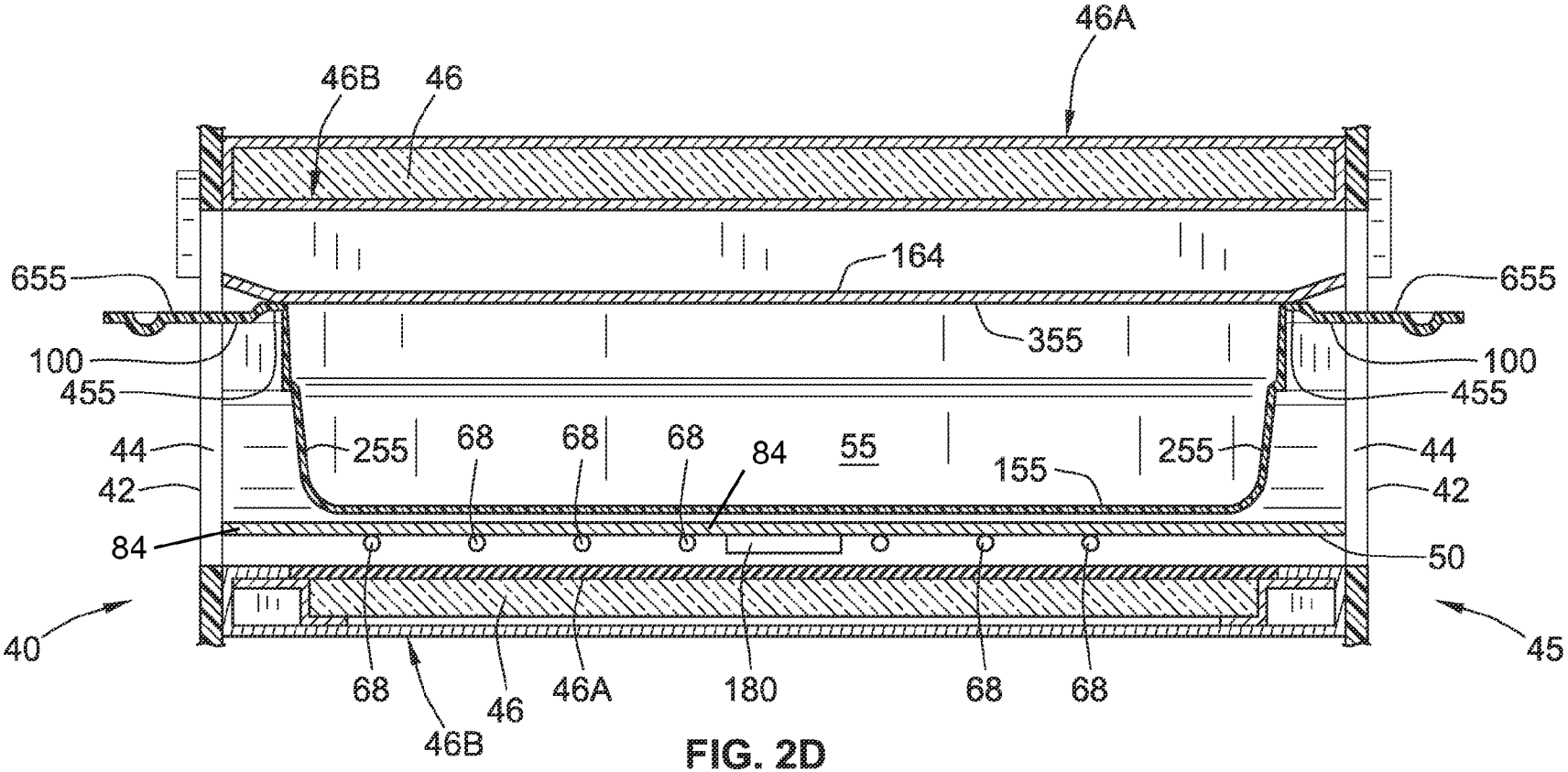
FIG. 2D is a side view of the tier shown in FIG. 2C.

The tiers are vertically separated from each other and defined by planar, horizontal and thermally-insulated shelves 46, best seen in FIG. 2C and FIG. 2D. Each shelf 46 is comprised of a top surface panel (top panel) 46A and a bottom surface panel (bottom panel) 46B. The panels 46A and 46B are preferably made from aluminum plate.

The separation distance or space between the top and bottom panels 46A and 46B defines an intra-shelf space. The intra-shelf space between the plates 46A and 46B is preferably at least partially filled with a thermally insulating material such as a "rock wool" or fiberglass to thermally separate the panels 46A and 46B from each other but to also thermally separate vertically adjacent tiers A-D from each other. Thermally insulating the panels 46A and 46B from each other thus facilitates a temperature differential between vertically-adjacent tiers A-D.

As best seen in FIG. 1, bezels 92 cover exposed edges of the shelves and conceal what is inside the intra-shelf spaces. The bezels 92 also support information-bearing displays and user-input controls 93 for corresponding tray-receiving members 50 located in a tier immediately above a bezel 92. The bezel-mounted information-bearing displays, which include liquid crystal display (LCD) panels and user-input controls which include push-buttons and/or touch-sensitive screens, provide a "user interface" for computers inside the cabinet 10 that effectuate cabinet control. One or more keypads 56 also provide mechanisms for a user to input commands to computers that control the cabinet 10.

Computers that control refrigeration equipment are operatively coupled to the information-bearing displays, user controls and to the heat-absorbing refrigeration equipment and devices described below. The computers are preferably computers as disclosed in the Applicant's co-pending patent application entitled "Food Holding Cabinet Power Supplies with Downloadable Software," which was filed on Nov. 16, 2009 and which is identified by U.S. application Ser. No. 12/618,957. That patent application discloses, among other things, apparatuses and methods by which compartments of a food holding cabinet can be individually controlled using microprocessors having downloadable software. The content of U.S. application Ser. No. 12/618,957 is incorporated by reference in its entirety.

Each depicted cabinet embodiment is configured to have in each tier A-D, two, side-by-side, thermally-conductive and refrigerated, food-storage-tray-receiving members 50, which are referred to hereafter as tray-receiving members 50. As can be seen in the figures, each tray-receiving member 50 has two open ends, which are proximate to the front and rear sides 40 and 45 respectively. The tray-receiving members 50 also have a generally flat bottom 84 bounded by two vertical sides 88, shown in FIG. 2B. The bottom 84 and sides 88 imbue the tray-receiving members 50 with a shape and cross section similar to and/or reminiscent of, the Arabic letter U. Alternate embodiments of the cabinets depicted herein can have any number of tray-receiving members 50 in each tier A-D. Alternate cabinet embodiments can also have any number of tiers, including a single tier.

Tray-receiving members 50 are cast or extruded aluminum, which is considered herein to be a thermally conductive material. They are able to absorb or "sink" heat from an item placed inside a tray-receiving member as long as the temperature of the tray-receiving member 50 is less than the temperature of an item therein. Stated another way, the tray-receiving members 50 sink or absorb heat from food and/or food holding trays 55 placed inside the tray-receiving member 50, as long as the tray-receiving members are refrigerated or cooled to a temperature less than the food or food holding tray 55 placed inside. Depending on the size and shape of the food item, food holding tray 55 and tray-receiving members 50, heat energy can be transferred from a food item and/or tray 55, into a tray-receiving member 50 by one or more of conduction, radiation, and/or convection currents inside a tray-receiving member 50.

Figure 2E:
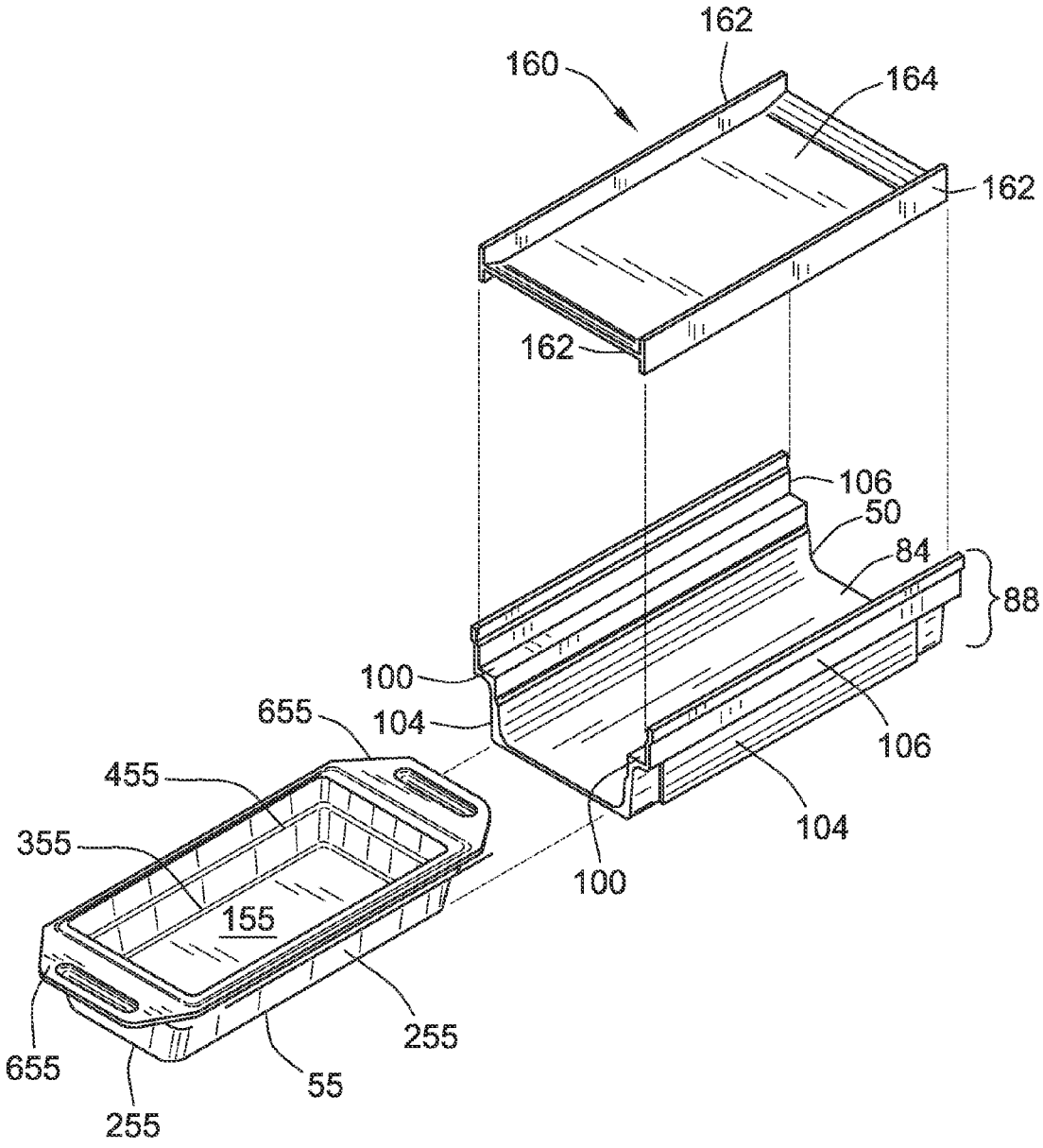
FIG. 2E is an exploded view of a tray-receiving member and food holding tray that fits within a tray receiving member.

Food holding trays 55 preferably have an exterior shape best seen in FIGS. 2A and 2E, which is reminiscent of a parallelepiped, except that one side of the parallelepiped corresponding to the top of the tray 55 is open. The trays 55 therefore have a cross sectional shape, which generally conforms to the generally U-shaped tray-receiving members 50. The cross section of a tray 55 and the cross section of a tray-receiving member 50 are thus both considered herein to have a shape reminiscent of the Arabic letter "U."

The cabinet 10 has a plurality of front panels 42, best seen in FIG. 1, having generally-U-shaped openings 44, which conform to the cross-sectional shape of the tray-receiving members 50. The front panels 42 allow items to be placed into and removed from the tray-receiving members 50 while concealing thermal insulation, refrigeration equipment and wiring considered herein to be "outside" the U-shaped tray-receiving members 50 but "inside" each tier A-D, i.e., located between two, vertically-adjacent shelves 46 that define each tier A-D. A rear panel not visible in FIG. 1 but which can be seen in cross section in FIG. 2D, has the same U-shaped openings 44 to conceal thermal insulation, refrigeration equipment and wiring from view from the rear of the cabinet.

The tray-receiving members 50, which are also referred to herein as compartments 50, are configured to receive food holding trays 55 through the openings 44 in the front and rear panels 42. An alternate cabinet embodiment not shown has a "closed" rear panel, which receives food holding trays 55 into tray-receiving members 50 through U-shaped openings 44 in the front panel 42.

The contents of the Applicant's co-pending patent application Ser. No. 12/763,553 are incorporated herein by reference. That application was filed Apr. 20, 2010, and is entitled, "Point-of-Use Holding Cabinet."

FIG. 2A, depicts a first embodiment of a refrigerated point-of-use holding cabinet 10A that uses a conventional, liquid-phase/vapor-phase refrigeration system 60 to refrigerate thermally-conductive tray-receiving members 50. The refrigeration cycle used by the system 60 is also known as either a gas refrigeration cycle or a reversed Brayton cycle. The system 60 can be used with or without regeneration.

A single compressor 62, single condenser 66 and a single fan 70 comprise a single, refrigeration system 60, and are depicted as being located along the right-hand side of the stacked tiers A-D, but nevertheless within the right-hand side panel 35 of the cabinet 10A. U-shaped, heat-exchanging evaporator coils 68 are mechanically attached to the outside or the "underside" of the tray-receiving members 50 in each tier A-D. The coils 68, which are typically made from copper or aluminum, are considered to be located outside or beneath the tray-receiving members 50 but "inside" the cabinet.

FIG. 2B is a perspective view of one tray-receiving member 50. It shows the evaporator coil 68 being generally U-shaped and conforming to the shape of the tray-receiving member 50, which enables the evaporator coil 68 to be thermally coupled to both the bottom 84 and sides 88 of the tray-receiving member 50. The coil 68 is attached to the underside of a tray-receiving member 50 by one or more of a thermally-conductive adhesive, welding, and/or brackets attached to the tray-receiving member 50 using screws, rivets or welding. In an alternate embodiment, the boustrophedonic evaporator coil 68 does not extend up the side walls 88 of the tray-receiving member 50 but is instead sized, shaped and arranged to be attached to only the underside of the bottom 84 of a U-shaped member 50. Heat energy in the side walls 88 is conducted downwardly into the refrigerated bottom 84.

Attaching the evaporator coil 68 to a tray-receiving member 50 thermally couples the heat-exchanging evaporator coil 68 to the tray-receiving member 50 and vice-versa. For clarity and claim construction purposes, the evaporator coil 68, the working fluid, as well as the entire refrigeration system 60, are all considered herein to be heat-absorbing refrigeration elements, since each of them is in either direct or indirect thermal communication with a corresponding tray-receiving member 50, and, each of them functions to remove or absorb heat energy from a tray-receiving member 50 and food items therein.

In one embodiment of the cabinet 10A, multiple, heat-exchanging evaporator coils 68 are connected in series to each other and a single compressor and condenser mounted substantially as shown in FIG. 2A. In such an embodiment, each evaporator coil 68 is mechanically attached to (and thermally coupled to) a corresponding tray-receiving member 50, in a corresponding tier. Unfortunately, in such an embodiment, effectuating different temperatures of different tray-receiving members 50 is problematic. In a cabinet 10A that uses a liquid-phase/vapor-phase refrigeration system one method of effectuating different temperatures in different tray-receiving members 50 refrigerates the tray-receiving members 50 but then adds heat to a tray-receiving member 50 using an electrically-resistive wire thermally coupled to the tray-receiving members 50.

In a cabinet that uses a liquid-phase/vapor-phase refrigeration system, a preferred way of providing independent temperature control of different tray-receiving member 50 is use a plurality of gas refrigeration systems 60 in each cabinet 10A. Components that include a compressor, condenser and expansion valve for small, conventional refrigeration systems 60 are readily provided along one or both sides of the tiers, above the top tier and/or below the lowest tier with each gas refrigeration system 60 being connected to a corresponding single evaporator coil 68 that is mechanically attached to and therefore in thermal communication with, a single, corresponding tray-receiving member 50. In such an alternate embodiment, one or more different tray-receiving members can be kept at a particular temperature by controlling the corresponding refrigeration system 60. Such an embodiment facilitates the temperature control of individual tray-receiving members 50, adds some functional redundancy to the cabinet 10A, and increases the overall heat absorption capacity of the cabinet 10A, but at the expense of additional manufacturing cost and complexity.

FIG. 2C is a cross-sectional view of one tier of the cabinet shown in FIG. 2A. FIG. 2D is a side view of the tier shown in FIG. 2C, take through the section lines 2D-2D. 2E is an exploded view of a tray-receiving member, tray 55 and cover 160.

As best seen in FIG. 2C, two side-by-side tray-receiving members 50 have cross-sectional shapes reminiscent of the Arabic letter "U." Both tray-receiving members 50 are attached to, and effectively suspended from the under side or lower side 46B of a shelf 46 located above the U-shaped tray-receiving members. The evaporator coil 68, which is best seen in FIG. 2B, can also be seen in FIG. 2C as extending across the bottom 84 of the tray-receiving member and partway up the sides 88. Food holding trays 55 rest inside the tray-receiving members 50 and in direct thermal contact with the bottom 84 of the tray-receiving members 50.

Those of ordinary skill in the art will appreciate that controlling tray-receiving member temperature is important to preserving food freshness. Foods stored in the cabinets are preferably kept at or below about forty degrees Fahrenheit. And, unless the food items are to be stored for extended periods of time, food items kept the cabinet 10A are also preferably kept from freezing.

Tray receiving member 50 temperature control is preferably effectuated in part using a semiconductor temperature sensor 180, as described in the Applicant's co-pending patent application identified by U.S. patent application Ser. No. 12/759,760, filed on Apr. 14, 2010. That patent application is entitled "Temperature Sensor for a Food Holding Cabinet." Its contents are incorporated herein by reference in entirety.

FIGS. 2C and 2D depict semiconductor temperature sensors 180 in direct mechanical and thermal contact with the outside surface of the bottom 84 of a tray-receiving member 50. Such sensors 180 are attached to the tray-receiving members by way of a double-sided thermally-conductive tape and/or a vulcanization layer, both of which are described in application Ser. No. 12/759,760. The sensor 180 shown in FIGS. 2C and 2D considered to be directly coupled to the tray-receiving members 50.

Figure 4A:
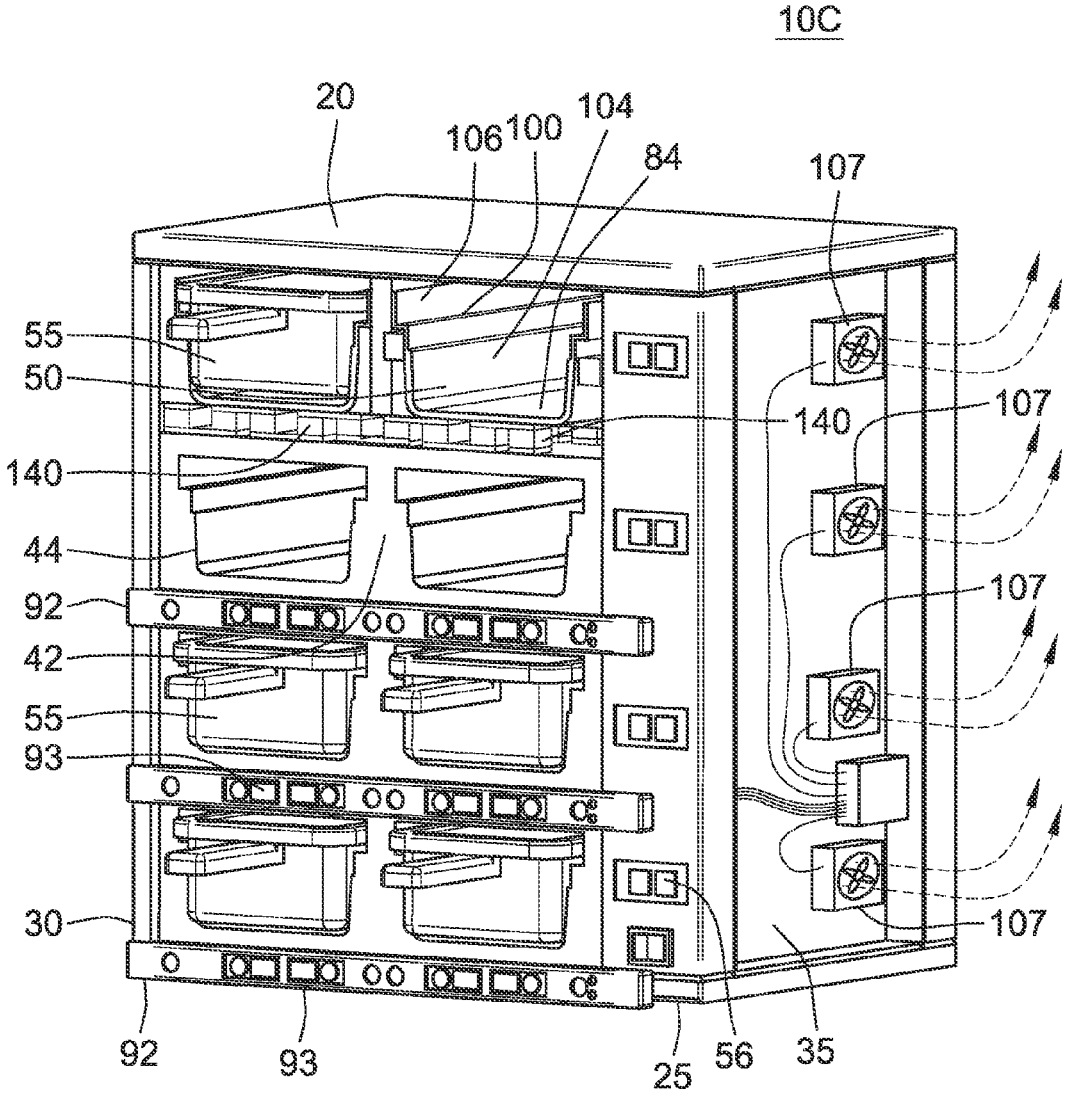
FIG. 4A is a perspective view of a third embodiment of a refrigerated, point-of-use food holding cabinet.
Figure 4B:
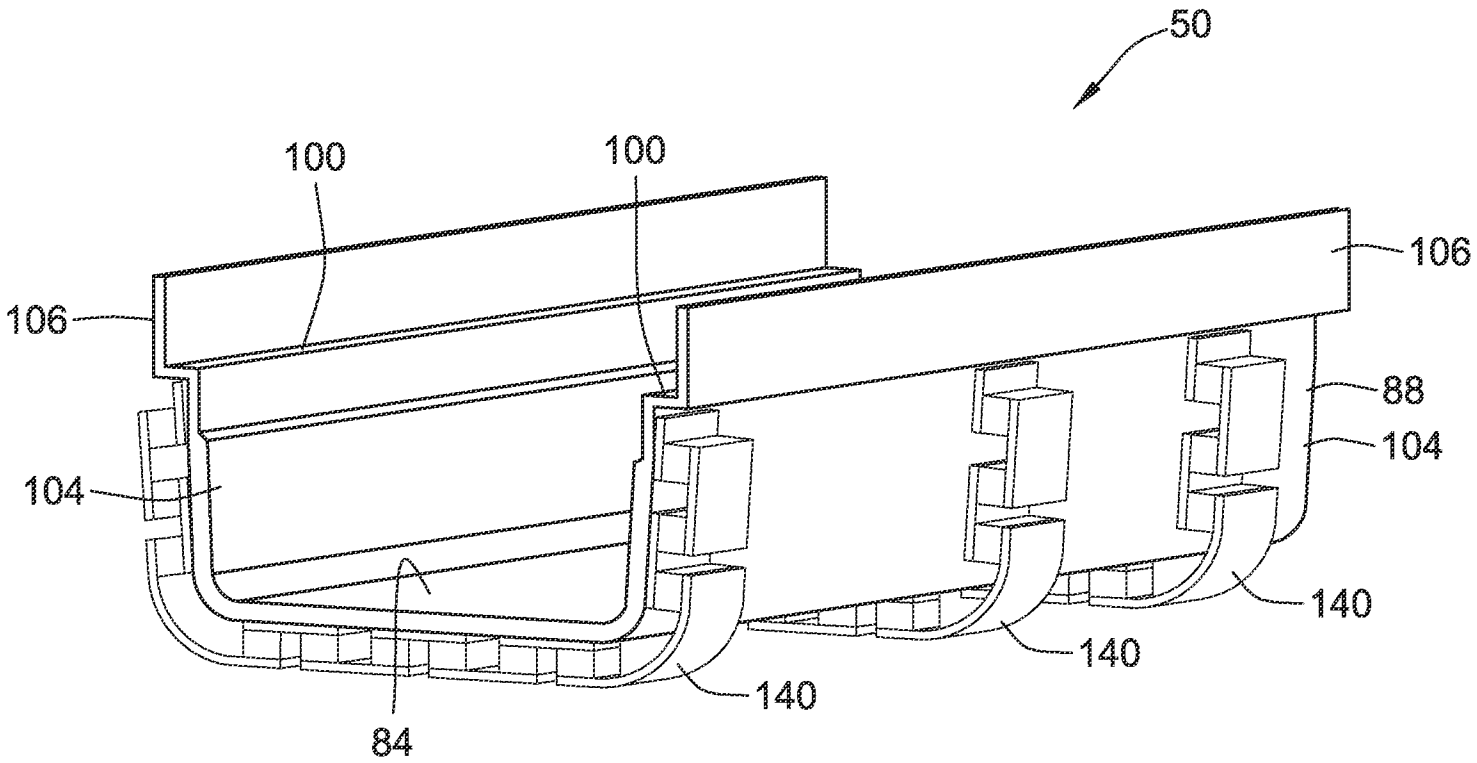
FIG. 4B depicts Peltier devices attached to the outside surfaces of the vertical sidewalls and the horizontal bottom of a tray receiving member.
Figure 4C:
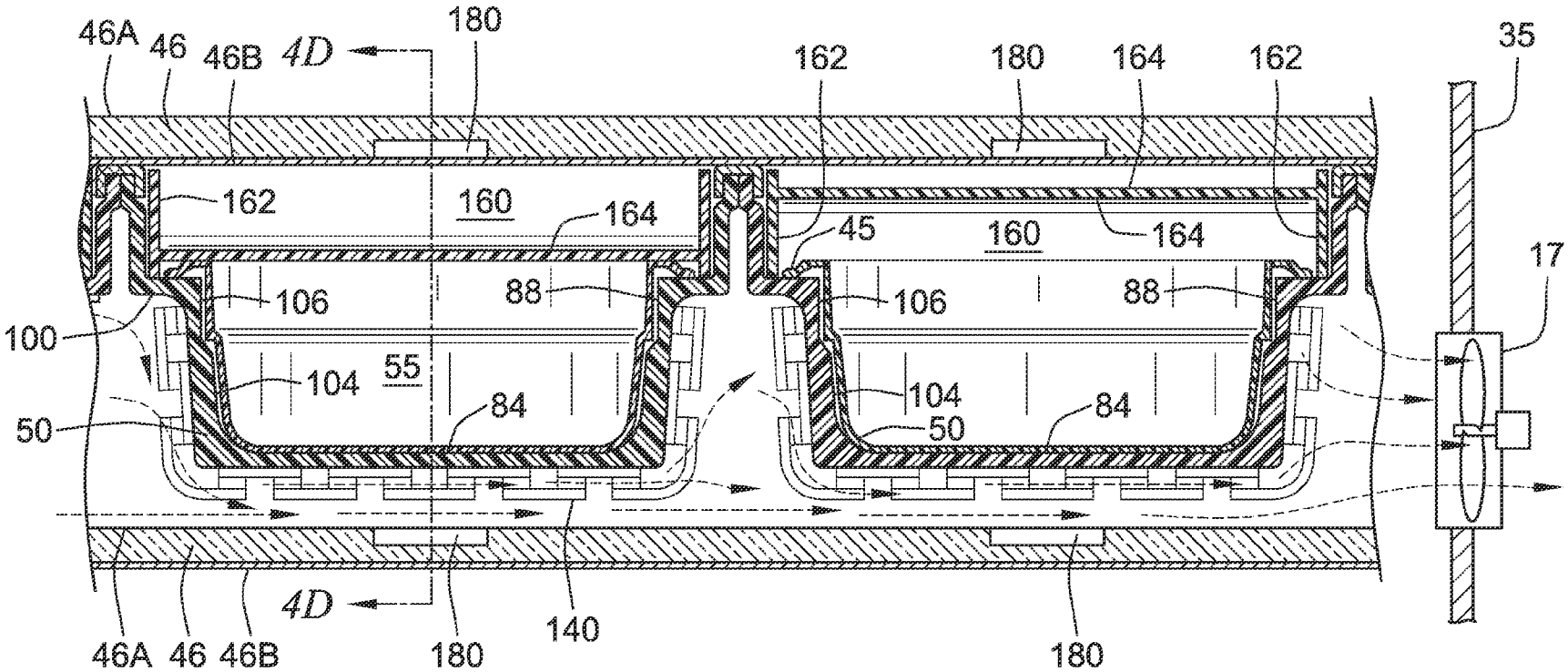
FIG. 4C depicts a cross sectional view through one tier of the cabinet shown in FIG. 4A.
Figure 4D:
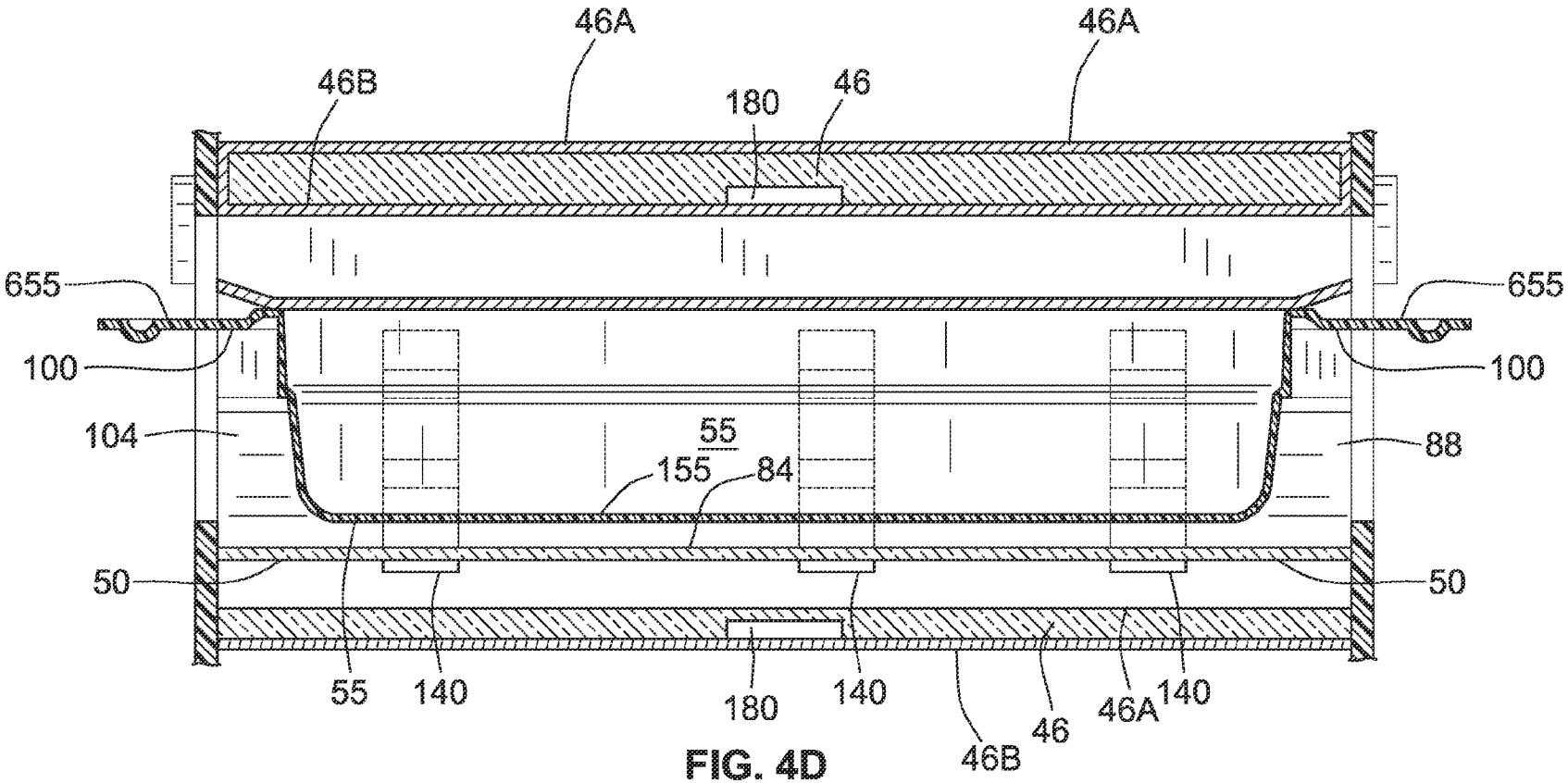
FIG. 4D is a side view of the tier shown in FIG. 4C.

FIGS. 4C and 4D depict semiconductor temperature sensors 180 attached to and therefore thermally coupled to the plates 46A and 46B that form a shelf 46. The sensors 180 in FIGS. 4C and 4D are attached to the plates 46A and 46B using one or both methods described in application Ser. No. 12/759,760. For purposes of this disclosure, FIGS. 4C and 4D depict an indirect coupling of the semiconductor sensors 180 to a refrigerated tray-receiving member 50. Such indirect coupling is provided by way of the heat transferred between the plates 46A and 46B and tray-receiving members 50 via one or more of conduction, radiation and convection.

FIG. 2E is an exploded view of a tray-receiving member 50 and food holding tray 55 that fits within a tray receiving member 50. FIG. 2E also shows an optional cover 160 that removably fits inside a tray-receiving member 50, meaning that a person can grasp the tray and easily remove it and/or replace it inside the tray receiving member by hand, i.e., without tools.

The generally parallelepiped-shaped food holding trays 55 preferably have a substantially planar bottom 155 and four generally planar sidewalls 255. The sidewalls 255 are substantially orthogonal to the bottom 155 and surround an upwardly-facing, open top side 355 through which food is placed into or removed from the tray 55.

The open top side 355 of a tray 55 is surrounded by "lip" 455 that extends outwardly and away from the open side 355 by about ½ inch. The "lip" 455 allows the tray 55 to "rest" or "sit" on horizontal shoulders 100 in the tray-receiving member 50 sidewalls 88. The shoulders 100 extend away from each other horizontally. One or more optional, elongated handles 655 extend away from the tops of corresponding sidewalls 255.

Food holding trays 55 are preferably made from a thermally-conductive material such as aluminum to enhance heat transfer from the tray 55 into the thermally-conductive tray-receiving member 50, regardless of how the tray-receiving member 50 is refrigerated. The generally U-shaped cross section of the tray-receiving members 50 facilitates the trays' insertion into, and removal from, tray-receiving members 50. More importantly, the generally U-shaped cross section being substantially the same shape of a tray-receiving member 50 means that more area of a tray is exposed to or in contact with a corresponding surface of a tray-receiving member, which means that heat energy in a tray 55 is more effectively transferred to a refrigerated, tray-receiving member 50 than might happen if the two bodies' shapes were significantly different.

As best seen in FIG. 2C, tray-receiving members 50, including the evaporator coils 68 attached thereto, are sized, shaped and arranged to be suspended from a bottom panel 46B of a shelf 46 by attaching the tray-receiving member 50 thereto. The tray-receiving members 50 can be glued, riveted, screwed or welded to the aluminum plate bottom panels 46B of a shelf 46 above the tray-receiving member 50. In an alternate embodiment, tray-receiving members 50, including the evaporator coils 68 attached thereto, are configured to rest or "sit" on the top surface 46A of a shelf 46 without a connection of the tray-receiving member 50 to the bottom panel 46B of a shelf 46 above the tray-receiving member 50. In yet another embodiment not shown, tray-receiving members 50 and the vertical separation distance of adjacent shelves 46 are configured such that tray receiving members 50 "rest" or "sit on" the top surface 46A of a first shelf 46 below the tray-receiving member 50 and meet the bottom surface 46B of a "second" shelf 46 above the tray-receiving member 50 so that the bottom surface 46B of the upper shelf 46 is in thermal communication with top edge of the tray-receiving member 50.

The sidewalls' 88 attachment, as shown in FIGS. 2B and 2E, to the bottom surface 46B of a shelf 46 above a tray-receiving member 50 effectively isolates food holding trays 55 stored within horizontally-adjacent tray-receiving members 50 of a tier. Such "horizontal isolation" of tray-receiving members 50 by the side walls 88 also facilitates temperature differentiation of horizontally-adjacent tray-receiving members 50 but it also reduces or eliminates flavor transfers between a first type of food product in one tray-receiving member 50 and a second type of food product in an adjacent tray-receiving member 50.

A close inspection of FIG. 2A reveals that side-by-side tray-receiving members 50 can also be horizontally separated from each other using a compartment-separating wall 52, which is also preferably insulated. Such compartment separation walls 52 extend between the bottom panel 46B of an upper shelf 46 and the top panel 46A of a vertically-adjacent lower shelf 46.

Flavor transfer and tray refrigeration is also improved using a cover over a tray-receiving member 50. As can be seen in FIG. 2E and in FIG. 2B, side walls 88 of a tray-receiving member 50 extend upwardly from the substantially planar bottom 84 of a tray-receiving member 50 by a predetermined distance, whereat the sidewalls 84 meet the aforementioned horizontally-oriented shoulder 100. The shoulders 100 extend away from each other horizontally and define an "upper" sidewall region 104 above the shoulder 100 and a "lower" sidewall region 106 below the shoulder 100. The horizontal distance separating the two upper sidewall regions 104 from each other is, of course, greater than the horizontal distance between the two lower sidewall regions 106, the separation difference being an amount equal to the combined horizontal widths of the shoulder 100 in each side wall 88.

The space above the shoulders 100 receives, and the shoulders 100 support, a removable and reversible cover 160 for food holding trays 55 placed into a tray-receiving member 50. The cover 160, which is preferably formed by casting or extruding, has a cross-sectional shape reminiscent of an upper-case letter "I" laid on one side. The cover 160 has a horizontal web section 164, which is "attached" to two, support legs 162. The support legs 162 are parallel to each other and orthogonal to the web section 164. The support legs 162 are sized, shaped and arranged, substantially as shown in FIG. 2E, to rest on the shoulders 100 formed into the sidewalls 88 of the tray-receiving member 50.

The horizontal web section 164 joins the vertically-oriented support legs 162 along a horizontal line vertically offset from the center line of the support legs 162. In a first orientation of the cover 160 best seen in the left-hand side of FIG. 2C, a tray 55 inside a tray-receiving member 50 has a web section 164 essentially in contact with and covering the open top 355 of the tray 55. In a second orientation best seen in the right-hand side of FIG. 2C, the cover 160 is inverted, relative to the left-hand side such that the web section 164 is above the lip of the tray 55 by a distance equal to the aforementioned offset providing a "vent" to the tray 55 when it is inside the tray-receiving member 50.

The distance of the sidewalls 100 above the bottom 84 of the tray-receiving member 50 and the shoulder width are a design choices but those dimensions are selected to enable a food tray 55 having an exterior, peripherally "lip" 455 to be slid into a tray receiving member 50 such that the tray's lip 455 rests on the shoulders 100 with an air gap between the sides of the tray 55 and the side walls 88 of the tray-receiving member 88 and with an air gap between the bottom 155 of the food holding tray 55 and the bottom 84 of the tray-receiving member 50. In such an embodiment, heat energy from the tray 55 is radiated from the tray 55 and absorbed by the cold surfaces of the tray-receiving member 50. Heat is also carried from the tray 55 by convection currents.

In another embodiment, tray-receiving member 50 has side walls 88 that do not have shoulders but are instead smooth or substantially smooth. In such an embodiment, a tray-receiving member has a horizontal separation distance between the side walls that is sufficient to allow a food holding tray 55 to rest directly on, and in direct thermal communication with the bottom of the tray-receiving member 50. Having an exterior surface of a food holding tray 55 in direct thermal contact with one or more surfaces of a tray-receiving member facilitates heat conduction from the tray 55 into a refrigerated, thermally-conductive tray receiving member.

Figure 3A:
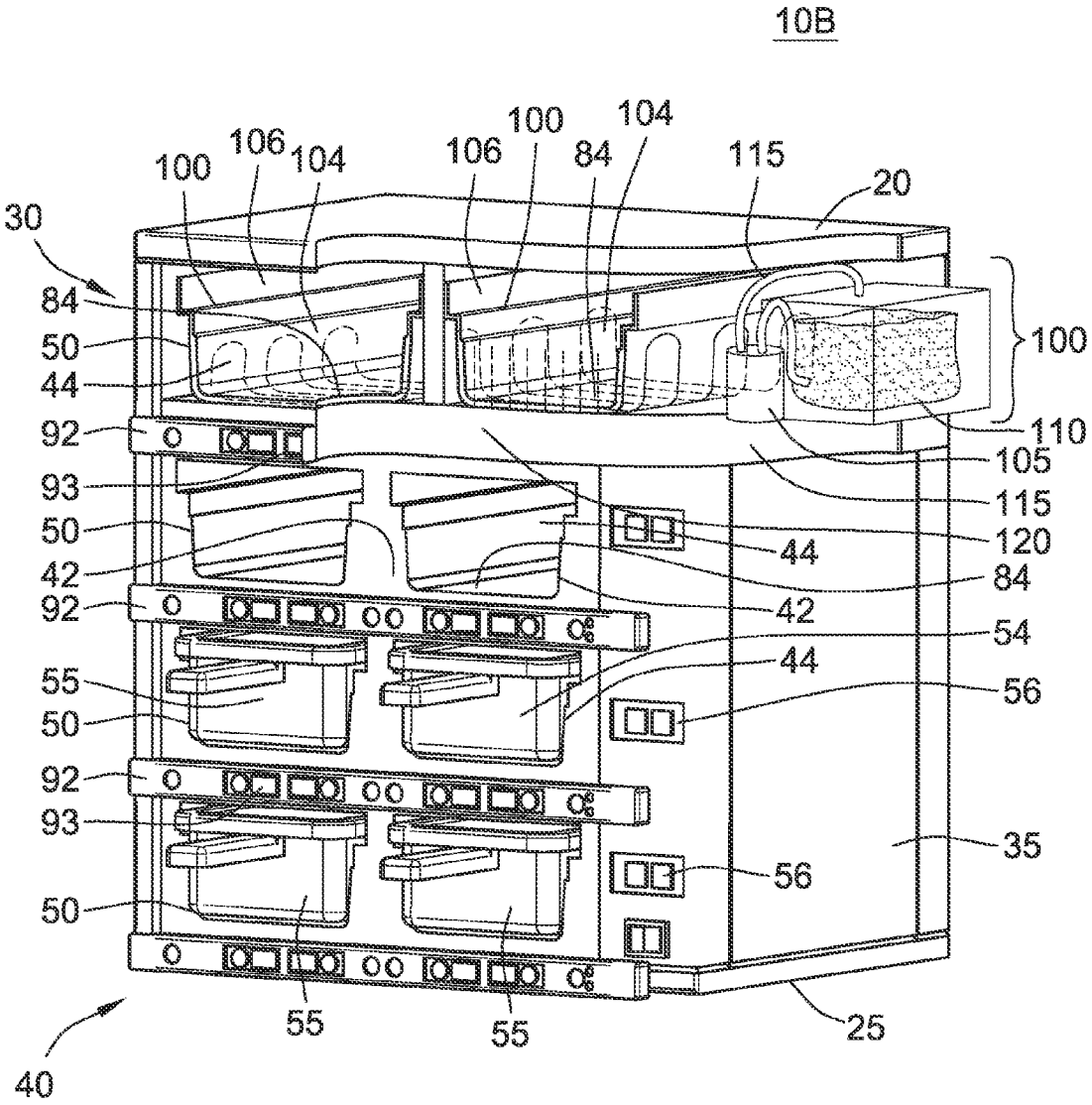
FIG. 3A is a perspective view of a second embodiment of a refrigerated food holding cabinet 10B.

FIG. 3A is a perspective view of a second embodiment of a refrigerated food holding cabinet 10B. The cabinet 10B as shown in FIG. 3A uses a refrigeration system 100 that circulates a chilled working fluid, which does not change phase as it circulates.

The working fluid used in the cabinet 10B of FIG. 3A is preferably oil or glycol. Working fluid stored in a tank 110, is chilled using a refrigeration system such as a conventional system 60 shown in FIG. 2A. The working fluid can also be chilled using one or more Peltier devices. Both refrigeration devices are omitted from the figure for clarity. The chilled working fluid is circulated through heat-exchanger refrigeration coils 120 that are mechanically attached to and in direct thermal communication with tray-receiving members 50. Regardless of the refrigeration methodology, working fluid is chilled in the tank to a temperature at which the temperature of tray-receiving members will be sufficiently lowered in order to keep food or trays 55, in the tray-receiving members 50, at or below about forty degrees Fahrenheit.

Figure 3B:
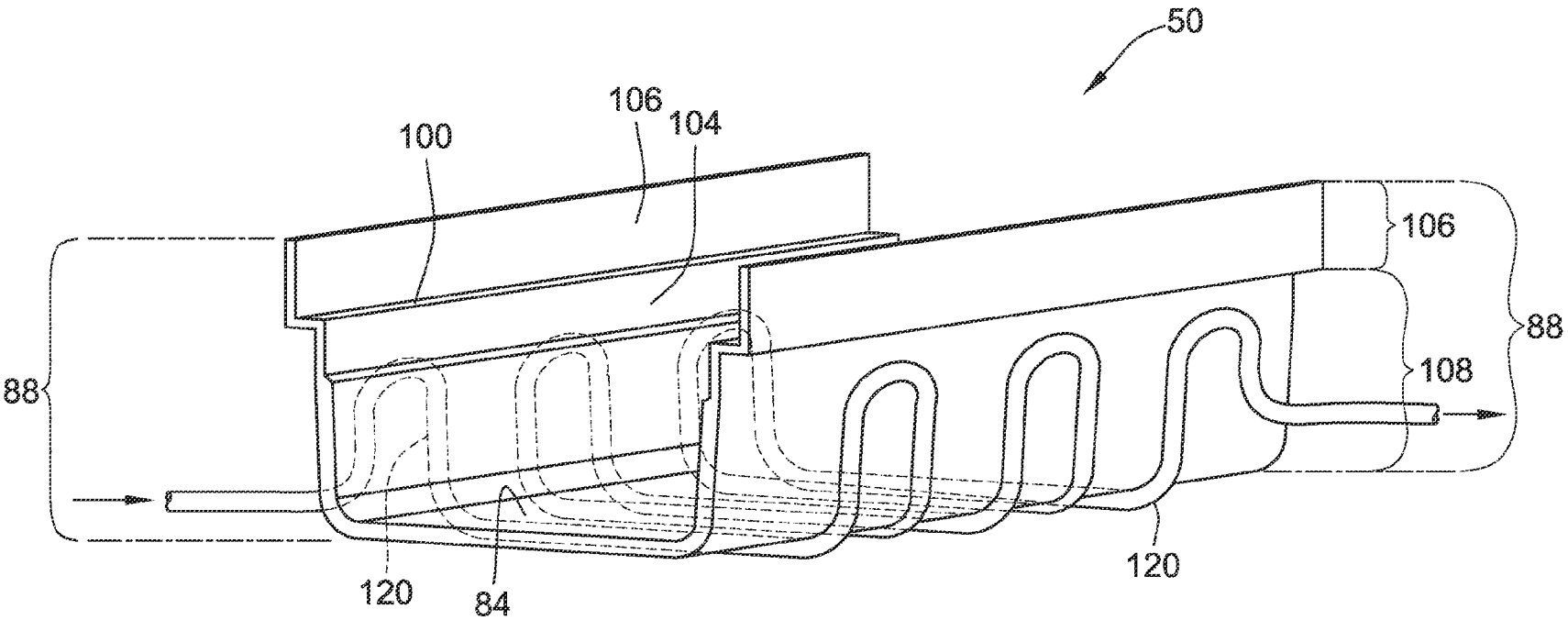
FIG. 3B is a perspective view of a tray-receiving member and a heat-exchanging coil used in the cabinet depicted in FIG. 2A

FIG. 3B is a perspective view of a tray-receiving member 50 and a heat-exchanging coil 120 used in the cabinet depicted in FIG. 2A. As with the embodiment shown in FIG. 2B, the coil 120 depicted in FIG. 3B is thermally coupled to the tray-receiving member 50 by virtue of its mechanical attachment thereto. Chilled liquid from the tank 110 is driven by a pump 105 through thermally-insulated flexible pipes or tubes 115 that connect the tank 110 to the thermally-conductive heat-exchanger coil 120, which is also a boustrophedonic coil 120.

The coil 120, which is preferably aluminum or copper, is mechanically attached to the underside of "outside" of the tray-receiving members 50 using thermally-conductive adhesive or mechanical fastening methods described above.

The liquid used in the second cabinet embodiment 10B is considered to be chilled or refrigerated if the liquid in the tank 110 is at least twenty degrees Fahrenheit, below the ambient air temperature. Due to the nature of the refrigeration cycle used in the cabinet 10B shown in FIG. 3A, the pressure on the working liquid is much lower than the pressure required in a conventional, liquid-phase/vapor-phase, refrigeration cycle. The lower pressure on the working fluid is an advantage over the gas refrigeration system shown in FIG. 2A because the chilled liquid can be controllably directed under software control to one or more different heat-exchanging coils 120 thermally coupled to different tray-receiving members 50. Selectively directing refrigerated working fluid to different coils 120 attached to corresponding tray-receiving members 50 facilitates individual temperature control of different tray-receiving members. Valves to electrically control a low pressure liquid flow, are well-known to those of ordinary skill in the mechanical engineering arts and omitted from the figures for clarity.

In addition to being able to selectively route chilled liquid using electrically operated valves, the chilled liquid volumetric flow rate through the heat exchanging coils 130 can be modulated electrically, further enabling individual temperature control of different tray-receiving members 50.

The refrigeration system 100 shown in FIG. 3A obviates the need for multiple refrigeration systems to achieve individual temperature control of separate tray-receiving members 50. For clarity purposes, heat-exchanging coil 120 and the chilled liquid are each considered to be heat-absorbing refrigeration elements. The entire system 100 is also considered to be a heat-absorbing refrigeration element.

FIG. 4A is a perspective view of a third embodiment of a refrigerated, point-of-use food holding cabinet 10C. The cabinet 10C shown in FIG. 4A differs from the cabinet shown in 2A and 3A in that it uses Peltier devices 140 to chill the tray-receiving members 50.

FIG. 4B depicts an example of how Peltier devices 140 can be mechanically attached to the outside surfaces of the vertical sidewalls 88 and the horizontal bottom 84 of a tray receiving member 50 by way of thermally-conductive adhesive, brackets, screws and/or rivets. The Peltier devices 140 are attached with the cold sides in direct contact with the thermally-conductive, U-shaped tray-receiving member 50. The Peltier devices 140 thus absorb heat energy from the tray-receiving member 50, which lowers the temperature of the tray-receiving member 50, enabling it to absorb heat energy from food or a food tray 55 inside the tray-receiving member 50.

A disadvantage of using Peltier devices 140 to sink heat from tray-receiving members 50 is that heat energy from the hot side of a Peltier device needs to be dissipated in order for the Peltier device 140 to be able to absorb heat into the cold side. In the cabinet 10C shown in FIG. 4A, heat energy from the hot side of a Peltier device 140 is dissipated into air, drawn over the hot sides by one or more fans 107.

FIG. 4C depicts a cross sectional view through one tier of the cabinet 10C shown in FIG. 4A. FIG. 4D is a side view through section lines 4C-4C. As shown in FIG. 4C, one or more fans 107 effectuate an air flow over the warm sides of Peltier devices 140 by drawing air in one side of the cabinet 10C and which subsequently flows over the hot sides of the Peltier devices 140. Warm air inside a tier is thus exhausted from one side of the cabinet and replaced by cooler air that flows into the opposite side of the cabinet.

Figure 4E:
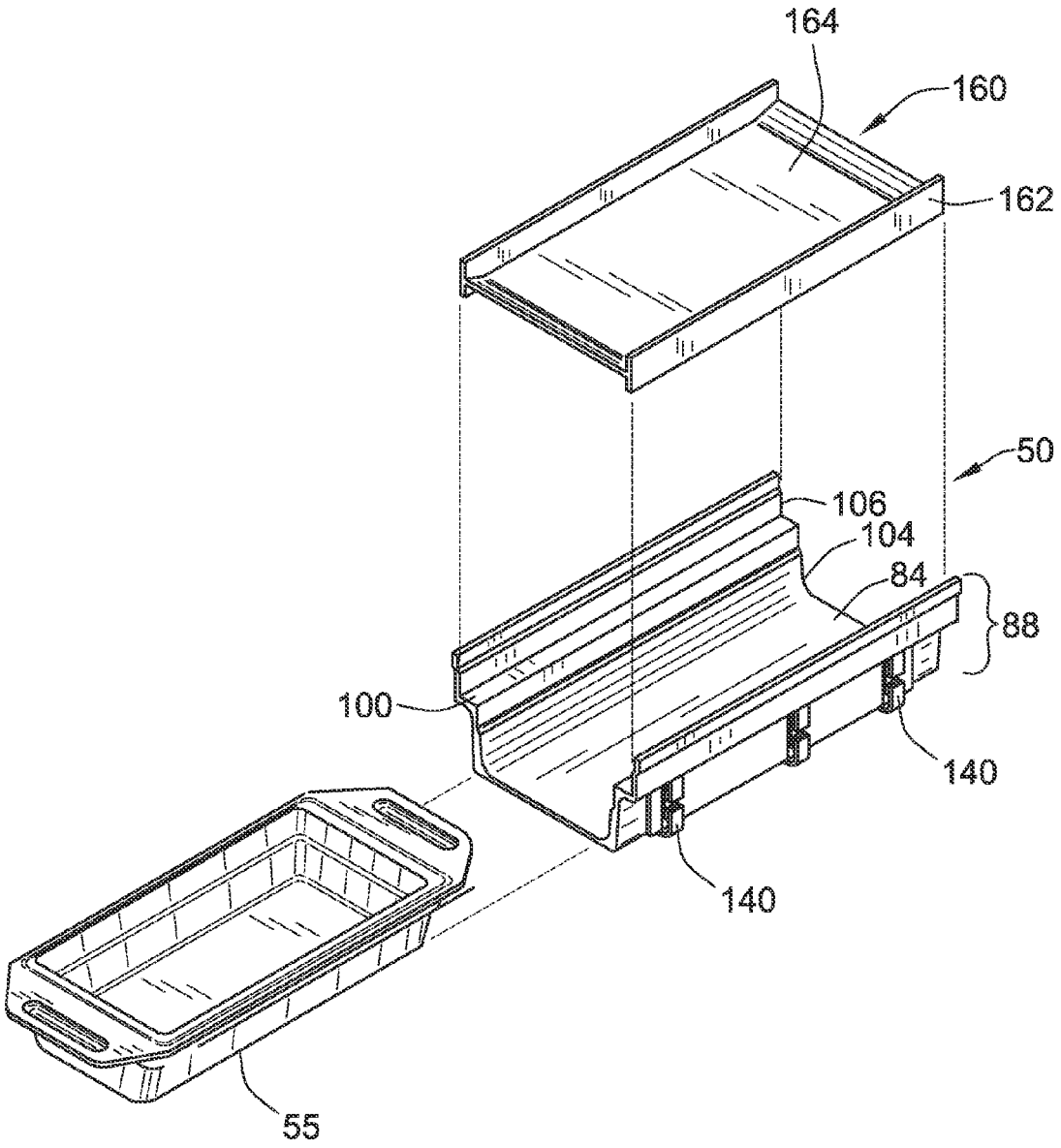
FIG. 4E is another perspective view of an alternate embodiment of a refrigerated point-of-use holding cabinet.

For completeness, FIG. 4E is an exploded view of a tray-receiving member 50 and food holding tray 55 that fits within a tray receiving member 50 chilled by Peltier devices 140. FIG. 4E also shows the optional cover 160, which fits inside the tray-receiving member 50.

As mentioned above, each cabinet embodiment controls tray-receiving member 50 temperature using one or more semiconductor temperature sensors 180 thermally coupled to a tray-receiving member 50. In FIGS. 2C and 2D, semiconductor temperature sensors 180 are directly attached to the outside of a tray-receiving member 50; they are thermally coupled directly to the tray-receiving member.

In FIGS. 4C and 4D, semiconductor temperature sensors are coupled to the lower side 46B of an "upper" shelf 46 of one of the tiers and/or the upper side 46A of a lower shelf 46. FIGS. 4C and 4D depict an alternate way of sensing the temperature of a tray-receiving member 50.

An electrical signal from a semi-conductor temperature sensor 180 that represents a tray-receiving member temperature is provided to a computer, as disclosed in the applicants co-pending patent application Ser. No. 12/618,957. The computer thereafter issues control signals to the refrigeration device, whether the device is the refrigeration system 60 depicted in FIG. 2A, the chilled liquid system 100 shown in FIG. 3A or Peltier devices 140 shown in FIG. 4A.

Figure 5:
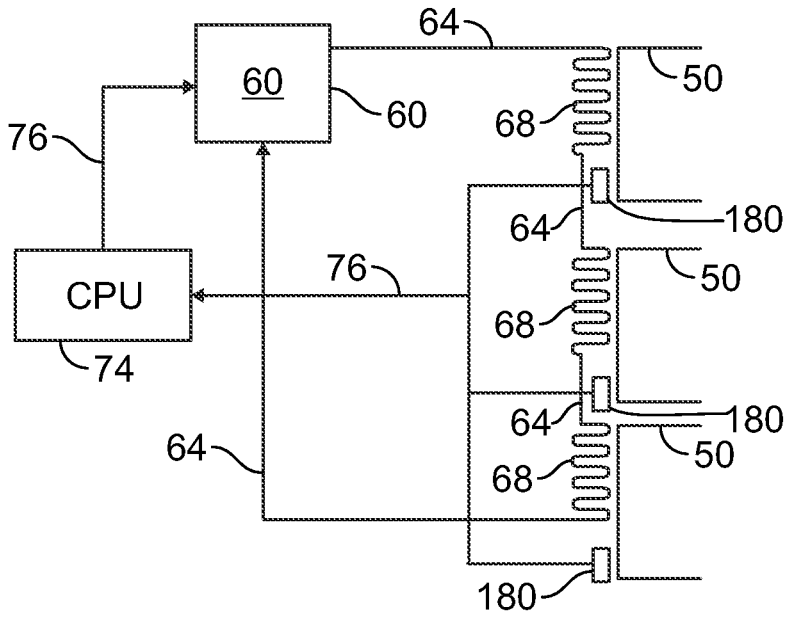
FIG. 5 is a block diagram of the tray-receiving member temperature control for the first embodiment shown in FIG. 2A.

FIG. 5 is a block diagram of one embodiment of tray-receiving member 50 temperature control, for the first cabinet embodiment 10A depicted in FIG. 2A. In FIG. 5, a master controller 74 for the cabinet 10A is embodied as either a microprocessor or microcontroller. It is electrically coupled to the semiconductor temperature sensors 180 and to the liquid-phase/vapor-phase refrigeration system via a bus 76. Interface devices that couple the CPU 74 to the refrigeration device compressor, as well as to the semiconductor temperature sensor 180 are omitted from FIG. 5 for clarity. Such devices are well known to those of ordinary skill in the electrical arts.

The master controller 74 reads electrical signals from one or more semiconductor temperature sensors 180 thermally coupled to various tray-receiving members 50. The CPU 74 turns the refrigeration system 60 on and off in response to temperature information received from the sensors 180. In one embodiment, the refrigeration system 60 is turned on when all of the sensors 180 indicate that the tray-receiving member 50 temperature is too high. In another embodiment, the refrigeration system is turned on when at least one temperature sensor 180 indicates that its corresponding tray-receiving member 50 temperature is too high.

Figure 6:
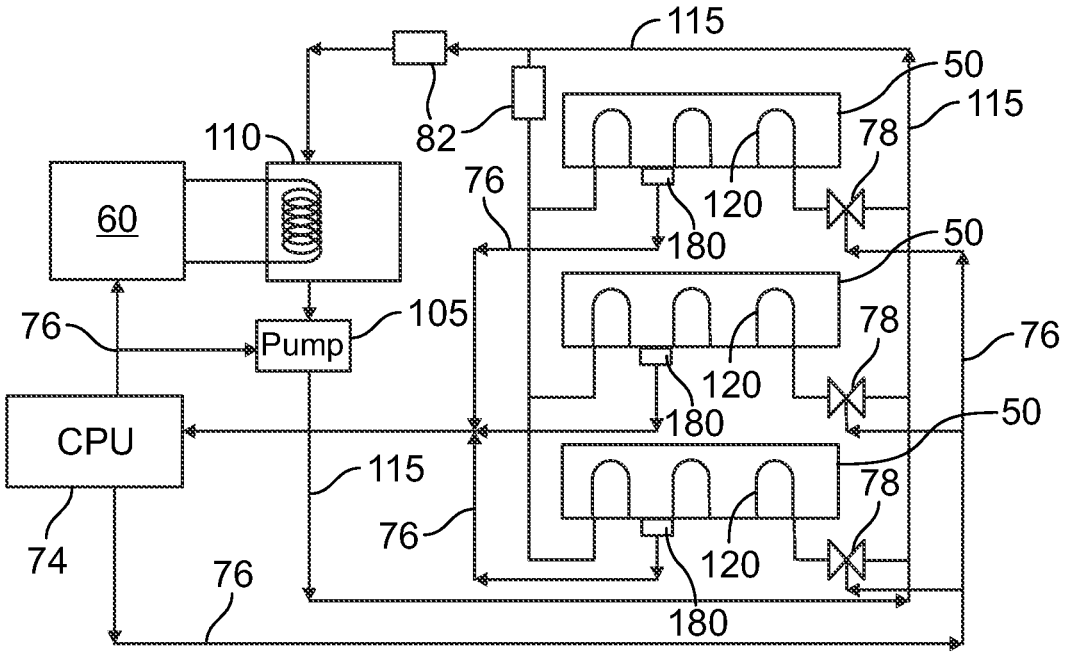
FIG. 6 is a block diagram of the tray-receiving member temperature control for the second embodiment shown in FIG. 3A.

FIG. 6 is a block diagram of one embodiment of tray-receiving member 50 temperature control, for the second cabinet embodiment 10B depicted in FIG. 3A. In FIG. 6, the bus 76 couples the master controller 74 to the semiconductor temperature sensors 180, a liquid-phase/vapor-phase refrigeration system 60, the pump 105 and to several, electrically-operated control valves 78, each of which enables chilled liquid flowing through the piping 115 to be routed through a corresponding heat exchanger 120 under software control. Interface devices that couple the CPU 74 to the refrigeration device compressor, the semiconductor temperature sensors 180 and to the valves 78, are omitted from FIG. 6 for clarity but such devices are well known to those of ordinary skill in the electrical arts.

As with the embodiment shown in FIG. 5, signals from the semiconductor temperature sensors 180 inform the CPU of the temperature of corresponding tray receiving members 50. If a tray-receiving member's temperature is determined to be too high, the CPU 74 activates the pump 105 to provide a slightly pressurized chilled working fluid to piping 115 that couples the heat exchanger coils 120 to the pump 105 and tank 110. After the pump 105 is turned on, or simultaneously therewith, the CPU 74 sends a signal to one or more of the electrically-actuated valves 78 for the tray-receiving members 50. Opening a valve 78 allows chilled liquid in the piping 115 to flow into the corresponding heat exchanger 120. Check valves 82 keep the liquid flowing in the proper direction. In addition to controlling the pump 105 and valves 78, the CPU 74 also controls the refrigeration system 60 to keep the working fluid in the tank 110 suitably chilled.

Figure 7:
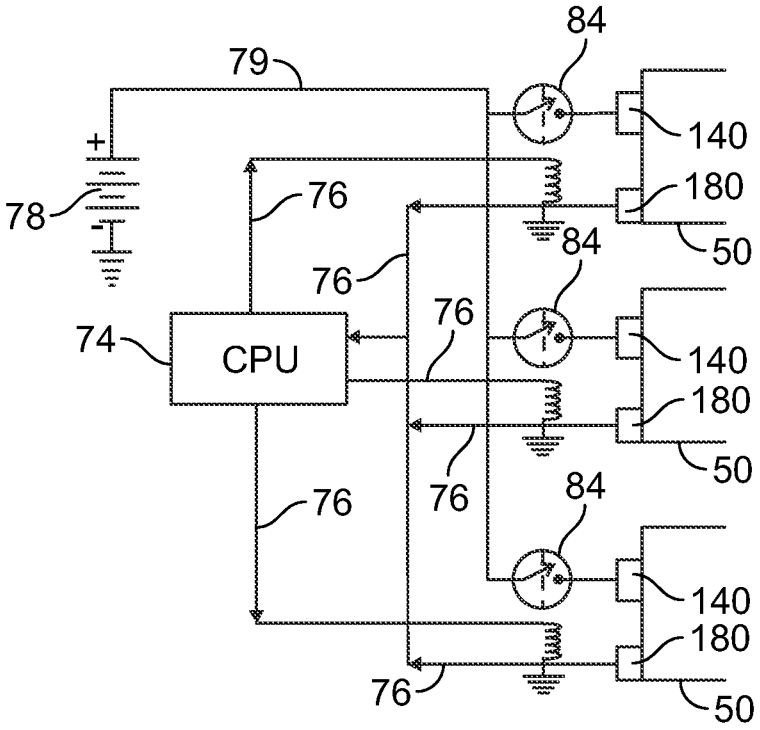
FIG. 7 is a block diagram of the tray-receiving member temperature control for the third embodiment shown in FIG. 4A.

FIG. 7 is a block diagram of one embodiment of tray-receiving member 50 temperature control, for the third cabinet embodiment 10C depicted in FIG. 4A. In FIG. 7, the bus 76 couples the master controller 74 to the semiconductor temperature sensors 180 and to solenoids 84 that provide power to the Peltier devices 140 from a power supply 78. Interface devices that couple the CPU 74 to those components are omitted from FIG. 7 for clarity.

As with the embodiments shown in FIGS. 5 and 6, signals from the semiconductor temperature sensors 180 inform the CPU of the temperature of corresponding tray receiving members 50. If a tray-receiving member 50 temperature is determined to be too high, the CPU 74 activates a corresponding solenoid 84 to provide electric energy to one or more Peltier devices 140 for the tray-receiving member 50 that is too warm. The same signal that actuates a solenoid can also be used to turn on the fan that ventilates the interior of the cabinet 10C and which cools the hot sides of the Peltier devices 140.

In each of FIGS. 5, 6 and 7, the CPU 74 effectuates temperature control of a tray-receiving member 50 by reading temperature information from a semiconductor temperature sensor 180 and activating a heat-absorbing refrigeration device. In a preferred embodiment, tray-receiving member temperature is kept low enough to keep food stored therein at a temperature below about forty degrees Fahrenheit. The ability of a tray-receiving member to keep a food item or a tray 55 below forty degrees will depend on factors that include but which are not limited to, ambient air temperature and the heat transfer capacity of the refrigeration system.

Those of ordinary skill in the art will recognize that the bottom and sidewalls of a tray-receiving member 50 define a cavity or void wherein a food holding tray 55 can be placed. Those of ordinary skill in the art will recognize that food to be kept cold can also be placed into the refrigerated, cavity without being in a tray 55. The term, "tray-receiving member" should therefore not be construed to require use of a food holding tray. A "tray-receiving member" includes a refrigerated device or structure capable of receiving and refrigerating food items such as wrapped sandwiches as well as food holding trays containing food items to be kept refrigerated.

The foregoing description is for purposes of illustration only and not for purposes of limitation. The true scope of the invention is set forth by the appurtenant claims.

What is claimed is:

1. A refrigerated food holding cabinet comprising:

a first tray receiving member having a bottom, first and second side opposing walls that extend upwardly from the bottom, and first and second opposing open ends, the first tray receiving member defining a cavity in which food or a food holding tray can be placed through either of the first and second opposing open ends;

a second tray receiving member having a bottom, first and second side opposing walls that extend upwardly from the bottom, and first and second opposing open ends, the second tray receiving member defining a cavity in which food or a food holding tray can be placed through either of the first and second opposing open ends; and a refrigeration system comprising:

a first heat exchanger coil, at least a portion of which is attached to the first tray receiving member;

a second heat exchanger coil, at least a portion of which is attached to the second tray receiving member;

a chilled working fluid, which circulates through the first heat exchanger coil and through the second heat exchanger coil, the chilled working fluid being a liquid that does not change phase as it circulates;

a tank configured to hold the chilled working fluid; and a single pump, the pump being coupled to the tank and to both the first and second heat exchanger coils, wherein the first heat exchanger coil, the second heat exchanger coil, and chilled working fluid flowing therethrough are configured to conduct heat energy away from the first tray receiving member and away from the second tray receiving member, and thereby conduct heat energy away from a food holding tray or food item placed on the bottom of the first tray receiving member or from a food holding tray or food item placed on the bottom of the second tray receiving member.

2. The food holding cabinet of claim 1, wherein the chilled working fluid comprises glycol.

3. The food holding cabinet of claim 1, wherein the chilled working fluid comprises oil.

4. The food holding cabinet of claim 1, wherein the refrigeration system is configured such that the chilled working fluid has a temperature below about forty degrees Fahrenheit.

5. The food holding cabinet of claim 1, wherein ambient air surrounding the cabinet has a temperature and wherein the refrigeration system is configured such that chilled working fluid has a temperature at least twenty degrees below the ambient air temperature.

6. The food holding cabinet of claim 1, wherein the first and second tray receiving members have a cross section that is substantially U-shaped.

7. The food holding cabinet according to claim 6, wherein the heat exchanger coils are generally U-shaped, and are attached to and conform to exterior surfaces of the first and second tray receiving members.

8. The food holding cabinet of claim 1, wherein the chilled working fluid flows through the first heat exchanger coil at a first volumetric flow rate and wherein the chilled working fluid flows through the second heat exchanger coil at a second and different volumetric flow rate.

9. The food holding cabinet of claim 1, wherein the first and second heat exchanger coils are connected in series to each other.

10. The food holding cabinet according to claim 1, further comprising an electrically-resistive wire coupled to the first, tray receiving member and configured to provide heat energy to the first tray receiving member.

11. The food holding cabinet according to claim 1, further comprising a first transistor comprising a P-N junction, the transistor being mechanically and thermally coupled to the first, tray receiving member and configured to effectuate control of the temperature of the first tray-receiving member by a calculation of the P-N junction's temperature from a measurement of a voltage across the P-N junction.

12. A refrigerated food holding cabinet comprising:

at least one tier;

first and second tray-receiving members within the at least one tier of the cabinet, each of the tray-receiving members being substantially parallelepiped-shaped, and having a substantially horizontal and substantially planar bottom and generally planar and opposing side walls extending substantially vertically from the substantially planar horizontal bottom, both of the first and second tray-receiving members having first and second opposing and open ends, the open ends being sized, shaped and arranged to allow a food or food storage tray to pass through them, the tray receiving members being configured such that food or a food holding tray placed in a tray receiving member will be in direct contact with the bottom of the tray receiving member; and a refrigeration system comprising:

a first heat exchanger coil attached directly to outside surfaces of the first substantially parallelepiped-shaped thermally-conductive tray receiving member;

a second heat exchanger coil attached directly to outside surfaces of the second substantially parallelepiped-shaped thermally-conductive tray receiving member;

a tank configured to hold a chilled liquid; and a single pump, the pump being coupled to the tank and to both the first and second heat exchanger coils; the chilled liquid being circulated by the pump through the first and second heat exchangers and the chilled liquid does not change phase as the chilled liquid circulates.

13. The refrigerated food holding cabinet of claim 12, wherein the first and second tray-receiving members have a cross section that is substantially U-shaped.

14. The refrigerated food holding cabinet of claim 12, further comprised of:

first and second cover members in corresponding ones of the first and second tray receiving members, each cover member having a horizontal web section that extends generally horizontally between opposing generally planar side walls of the first and second tray-receiving members respectively, the horizontal web section being sized, shaped and arranged to enclose the first and second tray-receiving members in which food holding trays are located;

whereby a food holding tray placed in a tray-receiving member will be covered by said cover members.

15. The refrigerated food holding cabinet according to claim 14, wherein the first and second tray-receiving members have generally planar side walls that have shoulders configured to support the cover members.

16. The refrigerated food holding cabinet of claim 12, further comprising an electrically-resistive wire coupled to at least one of the first and second tray-receiving members, the electrically-resistive wire being configured to provide heat to the at least one of the first and second tray-receiving members.

17. The refrigerated food holding cabinet of claim 12, further comprising a first transistor that is mechanically coupled to at least one thermally-conductive tray-receiving member and configured to effectuate temperature control of the at least one tray-receiving member.

* * * * *